United States Patent [19]

Levine

[11] Patent Number: 4,595,139

[45] Date of Patent: Jun. 17, 1986

[54] CONTROL FOR HUMIDIFIER OF THE TYPE USED WITH THERMOSTATICALLY CONTROLLED FURNACE

[76] Inventor: Michael R. Levine, Ann Arbor, Mich.

[21] Appl. No.: 670,166

[22] Filed: Nov. 13, 1984

[51] Int. Cl.[4] ..... B01F 3/02

[52] U.S. Cl. ..... 236/44 R; 236/46 E; 126/113

[58] Field of Search ..... 261/129, 26, DIG. 15, 261/DIG. 34; 236/11, 44 R, 44 A, 44 C, 46 R, 46 E; 126/113

[56] References Cited

U.S. PATENT DOCUMENTS 3,638,637 2/1972 Coffman, Jr. ..... 236/44 R X
4,361,273 11/1982 Levine et al. ..... 236/44 R X
4,485,966 12/1984 Cartmell et al. ..... 236/46 R

*Primary Examiner*—Harry B. Tanner
*Attorney, Agent, or Firm*—Krass and Young

[57] ABSTRACT

A control system for an electrically energized humidifier used with a hot-air furnace including an electric time-delay circuit and control means for manually adjusting the time delay. Each time the thermostat for the system energizes the furnace the humidifier is energized for the predetermined time delay or until the furnace is de-energized, whichever occurs first. The time delay is manually adjusted so that it is longer than the energization cycle of the furnace in warm weather and shorter than the energization cycle of the furnace in cold weather. It is also manually adjusted so that in cold weather at the maximum energization cycle, the humifidier does not produce condensation within the building. The relative humidity of the conditioned air thus decreases proportionately to increases in the atmospheric temperature.

11 Claims, 5 Drawing Figures

CONTROL FOR HUMIDIFIER OF THE TYPE USED WITH THERMOSTATICALLY CONTROLLED FURNACE

BACKGROUND OF THE INVENTION

This invention relates to humidifiers for use with forced hot air furnaces and more particularly to a control system that automatically adjusts the relative humidity of heated humidified air according to the external temperature.

PRIOR ART

Since cold air absorbs relatively low quantities of moisture, humidifiers are commonly used in connection with forced hot air furnaces to augment the low moisture content of the air they have heated. A high relative humidity is beneficial from a number of respects. From a health standpoint it prevents dry throats and nasal passages which promote the introduction of viruses. High relative humidity also minimizes evaporation from the skin and effectively produces a feeling of warmth at lower temperatures than would dry air. Humidity also seals the minute cracks in building structures to prevent the escape of heated air and prevents furniture from drying and cracking.

A forced hot air furnace typically has a blower which, when activated, causes cooled air to be returned to the furnace through duct work where it is blown past a heat exahanger to reheat the air. A typical humidifier introduces additional moisture to the forced airstream just after the air has been reheated for recirculation to the building. This moisture is generally introduced either by exposing water-soaked media to the airstream for evaporation of the water into the air or by spraying a mist of water droplets into the airstream. The warm air absorbs water more readily than would the cold air because of its low relative humidity. This moisturized hot air is then circulated throughout the rest of the building.

Relative humidity in the range of 30 to 50% is generally desirable but when the atmospheric temperature drops below freezing high relative humidity levels cause undesirable condensation on windows and exterior walls. The maximum relative humidity that can be tolerated without excessive condensation is proportional to the atmospheric temperatures below freezing and depends upon the particular building structure. In a typical residence the relative humidity must be gradually lowered to about 5 or 10% when the exterior temperature falls to about −15 degrees Celsius.

One common type of prior art humidifier is connected to the power source for the furnace blower so that the humidifier is energized whenever the blower is energized. These humidifiers are thus energized, like the furnace, for periods of time that increase as the atmospheric temperature decreases. They have no humidistat. In order to avoid the introduction of excessive moisture into the air at these low temperatures, these humidifiers must be undersized in terms of their moisture production per unit time operation. They will therefore not produce the desirable high humidity levels at higher atmospheric temperatures when the furnace is energized for short periods of time.

Another form of prior art humidifier employs a humidistat; i.e., a switch controlled by a relative humidity sensor so that the switch is opened and the humidifier de-energized when the moisture in the air exceeds a preset level that may be manually adjusted. The relative humidity setting of these humidistats must be manually adjusted seasonally with the atmospheric temperature to adjust the relative humidity sensor as a function of the atmospheric temperature. Users tend to neglect this task and for convenience often set this humidistat to a low level that will not produce condensation at low atmospheric temperatures and leave it there, resulting in an inadequate humidity level at higher temperatures. Systems with automatic humidistats using atmospheric temperature sensors are relatively expensive and difficult to install and have not gained popularity. The humidity sensing elements used in these devices also tend to be expensive and inaccurate.

Consequently, a need exists for a simple easily-set humidistat which is effective over the full range of atmospheric temperatures.

SUMMARY OF THE INVENTION

The present invention is accordingly directed toward an automatic control system for a humidistat which provides maximum moisture output at relatively high atmospheric temperatures and decreases its output as the atmospheric temperature decreases. The control system of the present invention is simple so as to be low in cost and reliable in operation.

The control system of the present invention employs a time delay circuit or device, which is energized so as to begin timing when the power is applied to the furnace blower, operated in synchronism, or at a slight time delay with respect to the operation of the furnace. While the timer is operating, electrical power is applied to the humidifier. The humidifier operation is terminated either when power to the blower is shut off at the end of the furnace cycle or at the end of the timer cycle, whichever occurs first. The timer period is adjusted so that when the atmospheric temperature is above freezing the timer cycle will exceed the usual furnace operating cycle and accordingly the humidifier will operate whenever the blower operates, outputting a maximum volume of moisture.

When the atmospheric temperature decreases below approximately freezing, the durations of the furnace cycles will increase since more time will be required to raise the building temperature to setpoint. Despite the fact that the furnace will be operating a higher percentage of time, there will be fewer furnace cycles per unit of time because of this lengthened cycle duration. The duration of the furnace operating cycle will exceed the timer period and thus humidifier operation will be terminated before the furnace cycle ends. The combination of fewer heating cycles per unit time and humidifier operation for a fixed period of time during each heating cycle will diminish the relative humidity level produced by the humidifier during colder external temperatures.

DETAILED DESCRIPTION OF THE PREFERRED EMBODIMENT

Figure 1:
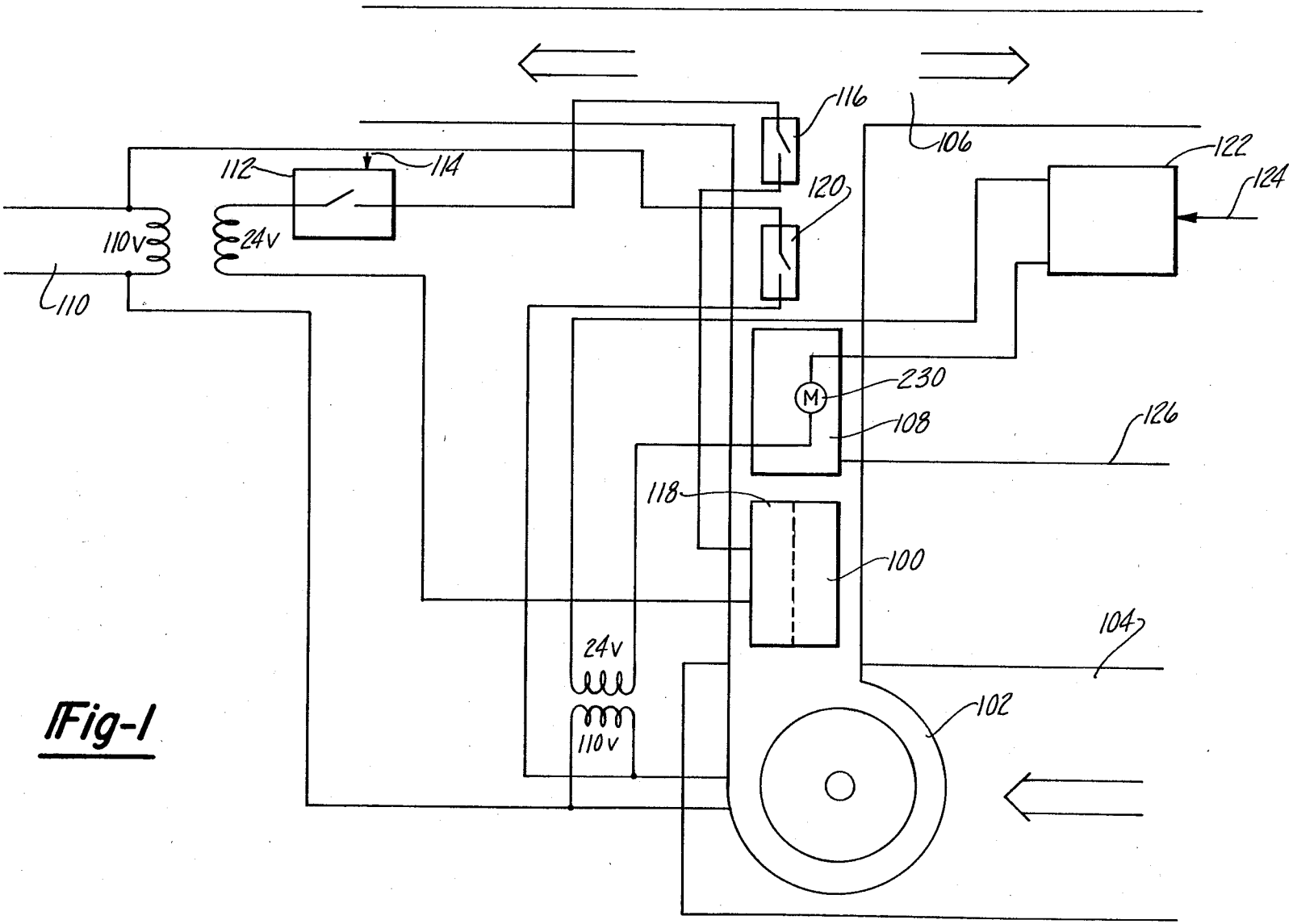
FIG. 1 is a schematic representation of the components of a typical hot-air furnace including a humidifier and the humidifier control circuit of the present invention.

Referring now to the drawings and more particularly to FIG. 1, there is schematically shown a hot-air furnace for heating and controlling the temperature in an enclosure such as a building. The furnace basically includes a heat exchanger 100 for heating the air, a blower 102 for circulating cold air past the heat exchanger, a return air plenum 104 for collecting the cooled air from the building to be heated and a hot air plenum 106 for distributing the heated air to the enclosure. This hot-air furnace also includes a humidifier 108 for adding humidity to the air which has been heated by the heat exchanger 100.

The components of the hot-air furnace just described are controlled by electrically powered control devices. More particularly, line power 110 powers a thermostat 112 which opens and closes contacts so as to maintain a set temperature as controlled by the setpoint control 114. When the ambient temperature in the environment to be heated falls below the setpoint temperature, the contacts of thermostat 112 close, allowing an electrical control signal to be passed to further control circuitry. Specifically, the thermostat control signal is provided to a normally closed high temperature limit switch 116 which opens if the temperature of the hot air plenum 106 exceeds a safe limit.

The thermostat control signal passes through high temperature limit switch 116 to the heat source 118 signalling that heat should be generated and passed to the exchanger 100. Line power 110 also passes to the normally open blower control switch 120, which closes when the temperature of the air in the hot air plenum exceeds a prescribed value. When the blower control switch 120 is closed, it powers the blower 102, causing the air heated by the heat exchanger 100 to be circulated throughout the environment. When the temperature in the hot air plenum 106 falls below the desired limit, the blower control switch 120 opens, turning off the blower 102 and discontinuing the circulation of the air throughout the environment.

The blower control switch 120, when closed, also provides power to the humidifier control circuit 122. This circuit operates to maintain humidity at a desired level according to a set control 124 by providing control signals to the humidifier 108. The humidifier 108 receives its electrical power from the humidifier control circuit 122 and also receives water from a supply pipe 126.

When the thermostat 112 calls for heat by closing its contacts, electrical power is then applied to switch 116. If a high temperature condition does not exist in the hot air plenum 106, switch 116 is closed, thereby sending a control signal to the heating energy source 118. This source generates heat energy and passes it to the heat exchanger 100, causing the warmth to be transferred to the air which is to circulate throughout the enclosure. As the temperature in the hot air plenum 106 begins to rise, the blower control switch 120 reaches its contact closure temperature. When this happens, the blower 102 is supplied with electrical power and the humidifier control circuit 122 is sent a control signal.

In a manner to be described later in this detailed description the humidifier control circuit 122 applies power to the humidifier 108 for a specified time or until the blower is turned off, whichever event occurs first. If the humidifier 108 is turned off by the humidifier circuit 122 because the prescribed time has elapsed, the heat source 118 continues to produce heat and exchange it to the circulating warm air through the heat exchanger 100, and the circulating blower 102 continues to circulate the still heating air throughout the enclosure.

Eventually the setpoint of the thermostat 112 is reached. At that time the thermostat opens, disconnecting all electrical power from the heat source 118. This allows the heat exchanger 100 to begin to cool. As it cools, the blower control switch 120 also cools until it reaches a point at which its contacts open, thereby discontinuing operation of the blower 102 and of the humidifier 108. The forced air heating system then awaits the next control signal from the thermostat 112 to begin heating the enclosure.

Discontinuance of electrical power to the humidifier control circuit 122, because of the opening of the fan control switch 120, causes it to reset. This means that at the next application of power to the humidifier control circuit 122 it will begin its timing function again, turning the humidifier on for the desired period of time.

The humidifier control circuit 122 can be implemented in many forms. In particular, it could be made from discrete electronic components or it could be implemented by a microprocessor. When programmed by one skilled in the art, a microprocessor implementation will perform all necessary timing and control operations accomplished by the humidifier control circuit made from discrete electronic components.

Figure 2:
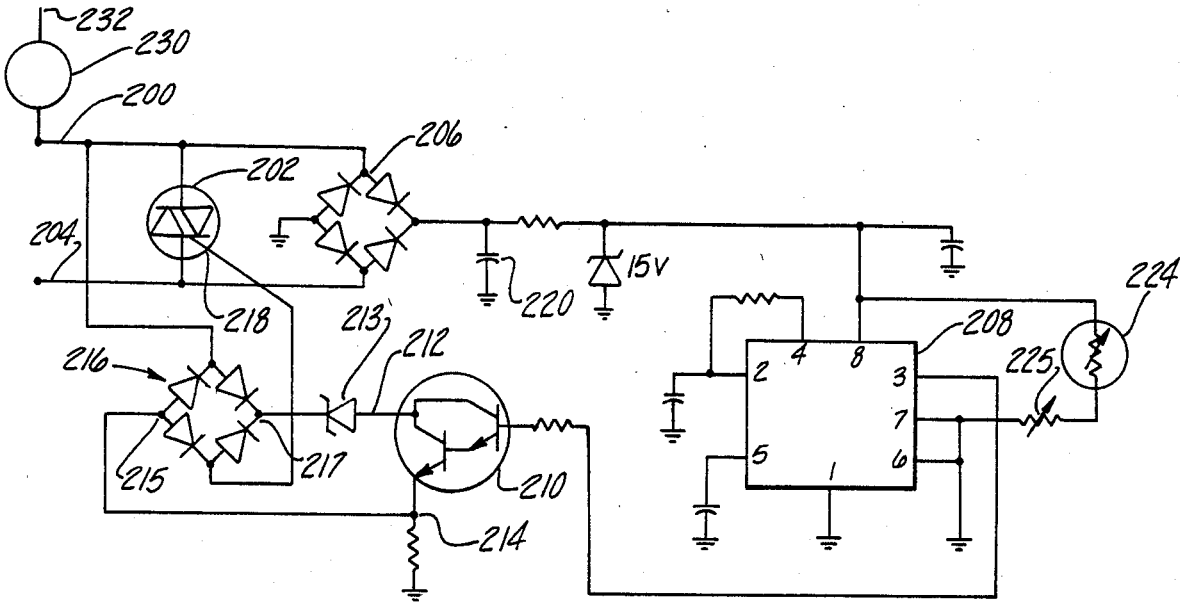
FIG. 2 is a schematic diagram of the circuitry of the humidifier control.

When the blower control switch 120 closes its contacts, 24 volts ac is applied between terminal 232 of the humidifier motor 230 and line 204 in FIG. 2. Line 200 is connected to the other terminal of the humidifier motor 230. Beginning at the point where the 24 volt ac voltage is rising from 0 volts, the voltage across full wave rectifier 206 (composed of 1N4002 diodes) begins to rise. This voltage charges a 2.2 miocrofarad capacitor 220 providing the timer 208 (such as an Intersil ICM 7555P) with its supply voltage.

For a period of time determined by its trim and time set potentiometers 225 and 224, respectively, the timer 208 supplies a control voltage to a Darlington pair 210 (such as an MPSA 13, available from Rohm Electronics), causing it to conduct. The voltage between the collector 212 and the emitter 214 of the Darlington pair 210 then falls to approximately 1.0 volts. This voltage drop, in series with the voltage drop which exists across the Zener diode 213 (with a 6.2 volts breakdown voltage, such as a 1N4735, available from American Power Devices), appears between points 215 and 217 of the full wave rectifier 216 (also made from 1N4002 diodes). The voltage between points 215 and 217 rises to about 7 volts, at which point the breakdown voltage of the Zener diode 213 is reached. Following this, the turn-on gate 218 of the triac 202 (such as a Teccor Q2001 F41) is subjected to the full voltage of the 24 V ac waveform, less approximately 8 volts, the voltage drop across the collector 212 and emitter 214 of the Darlington pair 210, the Zener diode 213 and points 215 and 217 of full wave rectifier 216.

As this voltage continues to rise, the triac 202 starts conducting. This causes voltage between 200 and 204 to be under approximately 1 volt. Therefore the rest of the voltage provided by the 24 volt ac waveform is supplied to the humidifier motor.

As the voltage between one terminal of the humidifier motor and line 204 of the humidifier control circuit decreases toward approximately 0 volts, triac 202 ceases conducting. This forces the full voltage of this portion of the 24 volt ac waveform to be imposed across the triac 202. Virtually none is available to the humidifier motor 230. The triac 202 continues to be subject to this portion of the 24 volt ac waveform until the time when the voltage between lines 200 and 204 exceeds approximately minus 8 volts. At this time, the triac 202 again turns on. Until this time, however, almost all of the 24 volt ac waveform is available to provide power to the timer circuit.

The operation of the humidifier control circuit just described continues until the timer period elapses and the timer 208 turns off the control signal to the Darlington pair 210. This event breaks the connection between the collector 212 and emitter 214 of the Darlington pair 210, preventing any further voltages from being placed on the turn-on gate 218 of the triac 202. This causes virtually the full 24 volt ac waveform to be applied between 200 and 204. Therefore, during the remainder of this timing cycle, the triac 202 never conducts and the humidifier motor 230 does not operate.

Figure 3:
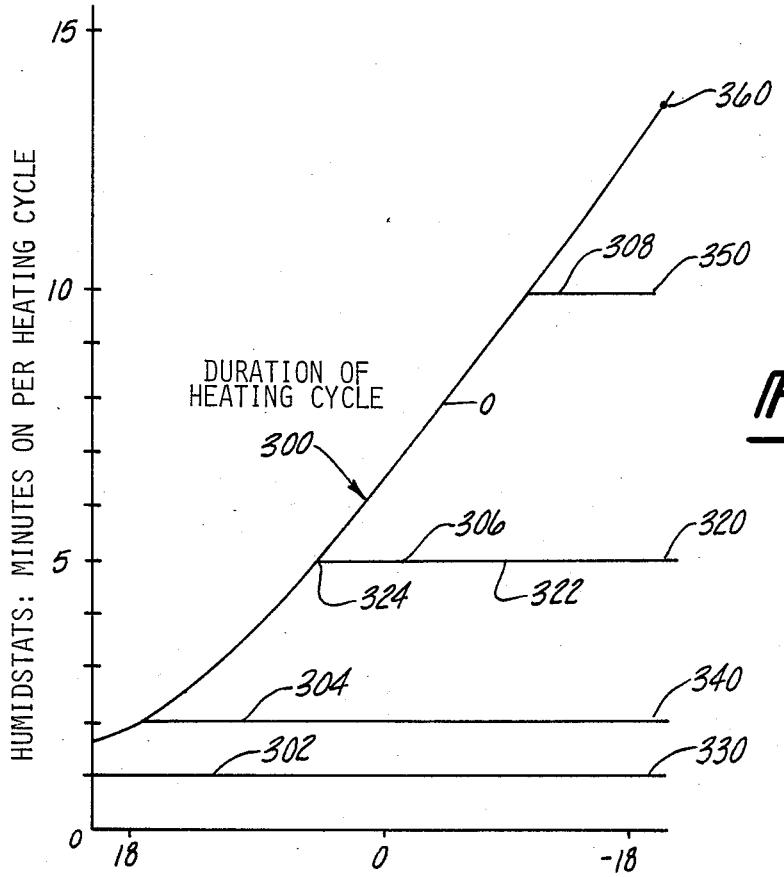
FIGS. 3, 4 and 5 are atmospheric temperature-based graphs useful in explaining the operation of the humidifier control circuit of the present invention.

Referring now to FIG. 3, a graph of the time period of humidifier operation per heating cycle as a function of outside temperature, note that the curve labelled 300 describes the duration of the heating cycle in minutes as a function of the outside temperature. As noted in connection with the description of FIG. 2, the duration of the humidifier operation cannot exceed the duration of the heating cycle itself. Therefore, the straight line curves 302, 304, 306 and 308 which correspond to humidifier energization periods of one minute, two minutes, five minutes and ten minutes, respectively, exist only for temperatures colder than those established by the duration of heating cycle curve 300.

To illustrate timing involved in the humidifier control circuit, assume that the timer has been set to have a five minute period corresponding to curve 306 in FIG. 3. Point numbers 320, 322 and 324 illustrate that for a five minute setting, the humidifier is on for five minutes during each heating cycle. This condition applies for temperatures for between −18° Celsius (which corresponds to point 320) and approximately +6° Celsius (which corresponds to point 324). If the humidifier is still set to have a time out period of five minutes and the temperature is greater than +6° Celsius, the humidifier operation is described by following curve 300. This may be seen to imply that for temperatures greater than +6° C., the number of minutes of humidifier operation for each heating cycle is equal to the duration of the heating cycle itself. In other words, the humidifier control system is turned off by the removal of electrical power from line 200 in FIG. 2 causing the timer control circuit to reset itself.

Figure 4:
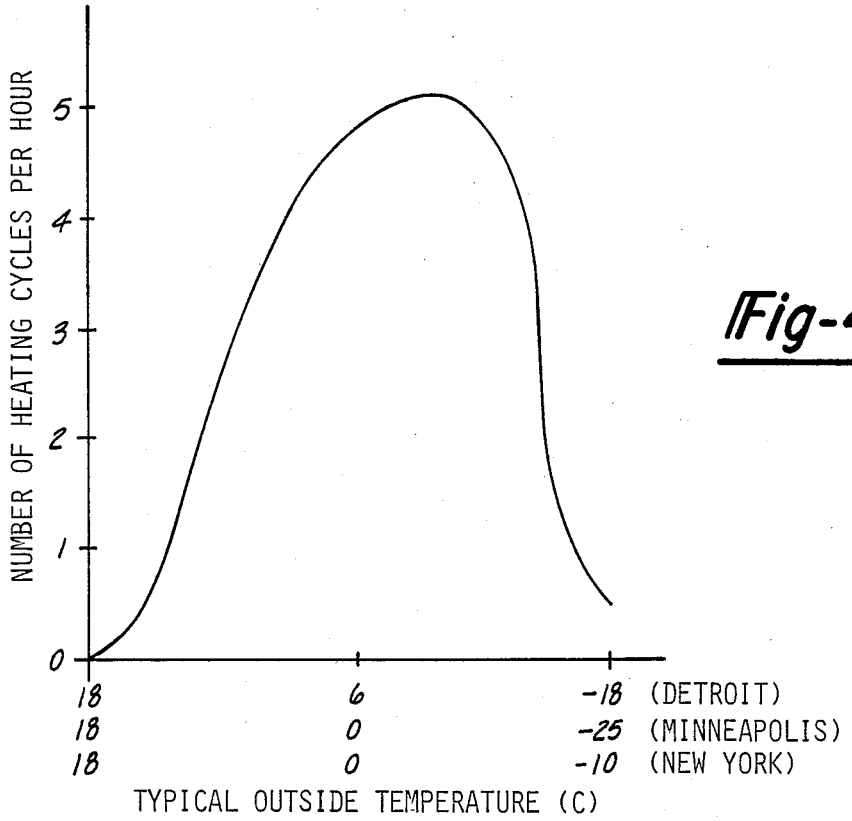

Referring now to FIG. 4 of the drawing, a plot of a typical number of heating cycles per hour as a function of the outside temperature, it may be observed that at an outside temperature of approximately 18° C., the furnace system is effectively turned off, therefore producing approximately zero heating cycles per hour. As the temperature cools down, however, moving to the right in the graph of FIG. 4, the number of heating cycles per hour increases to a maximum. Beyond this point the number of heating cycles per hour decreases again.

This behavior is caused by the tradeoff at which the heat can be applied by the heating system and the rate at which the heat is passed from the interior of the enclosure to the outside atmosphere. During warm temperatures where the inside and outside temperatures are approximately equal, it takes only a relatively short period of time to heat the enclosure to the desired temperature and it takes a very long period of time for the interior temperature to fall to the level where the heating system calls for more heat.

On the other hand, at very cold temperatures, the amount of heat required to keep the enclosure warm is significantly greater because of the greater temperature difference between the inside of the enclosure and the outside temperature. Therefore, it takes longer to cause a given temperature rise within the enclosure and less time for the temperature again to fall from that desired temperature to the setpoint temperature of the thermostat. The arguments above imply that the heating cycles are relatively long in cold temperatures whereas in warm temperatures they are shorter. At intermediate temperatures, the relationship between inside and outside temperature and the heat production rate causes the number of heating cycles per hour to reach a peak. The number of heating cycles per hour falls off at temperatures above and below the temperature at which that peak exists.

Figure 5:
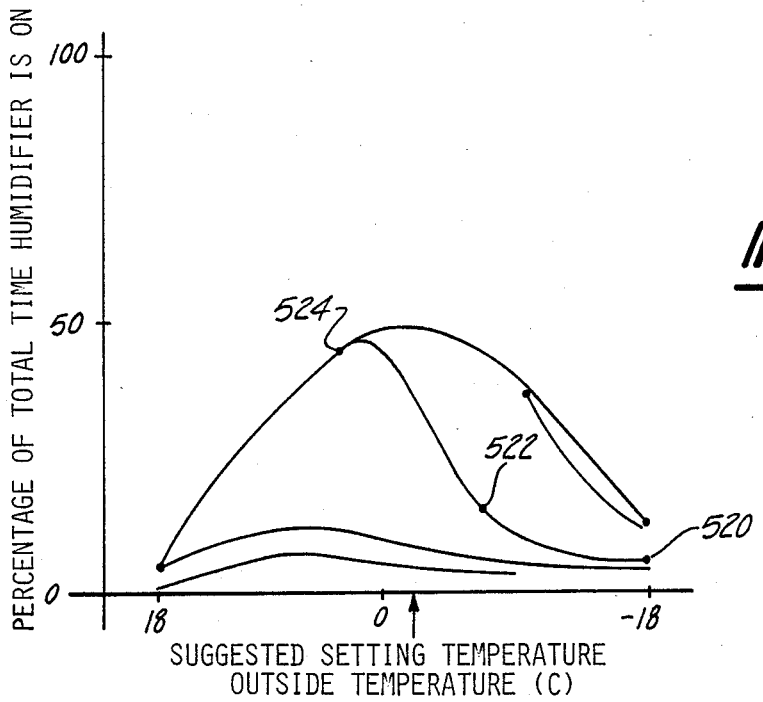

Referring to FIG. 5 of the drawings, a graph of the percentage of total time that the humidifier is on as a function of outside temperature, note that these curves may be derived from the curves shown in FIGS. 3 and 4 as follows: selecting a point 324 in FIG. 3 which occurs at an outside temperature of approximately +6° C., the number of minutes per heating cycle given by that curve (five minutes in this case) is multiplied by the number of heating cycles per hour as described by the curve in FIG. 4 (four and one-half times in this case).

Therefore, the number of minutes that the humidifier is in operation for every hour can be determined by multiplying a five minute heating cycle by four and one-half heating cycles per hour. This calculates to 22½ minutes per hour which is slightly more than one third of the total time it is possible for the humidifier to be on. This point is shown as point 524 in FIG. 5.

This same approach can be applied to generate the rest of the curves shown in FIG. 5. Therefore, points 520, 522 and 524 correspond to points 320, 322 and 324 of FIG. 3 located on the five minute timer-on curve 306. The curve produced for each particular timer setting may then be established by starting at the right hand side of FIG. 5 (corresponding to very cold conditions) following that curve to the left. The resulting curve shows that the percentage of total time that the humidifier is energized increases until it reaches a certain peak value at which time it begins to diminish again as the outside temperature continues to increase. This implies that for a given timer-on period, the humidifier is energized for some maximum percentage of total time at a temperature intermediate to the lowest and highest external temperatures.

The curves in FIG. 5 tend to peak out at approximately 0° C., indicating that the greatest percentage of humidifier time-on occurs at that approximate temperature range. It is at an approximate external temperature of 0° C., then, that the timer of the humidifier control circuit should be set. The proper setting is established by initially adjusting the potentiometer 224 to its highest setting and lowering the setting slightly each time condensation is noted on the windows until no condensation occurs at any temperature. This represents the optimum setting.

When the humidifier control circuit 122 (in FIG. 1) is a microprocessor implementation, all of the above-described timing and control functions can be accomplished. In addition, adjustment of the duration of the humidifier operation can be accomplished at more than one outside temperature by relating this outside temperature to the duration of the heating cycle, as exemplified by feature 300 of FIG. 3. When the duration of the humidifier cycle is adjusted, the microprocessor relates this adjustment to the present duration of the heating cycle, and thereafter, unless further adjusted, the microprocessor will leave the humidifier on for the newly adjusted number of minutes.

The humidifier control circuit of the present invention and many of its attendant advantages will be understood from the foregoing description and it will be apparent that various changes may be made in form, construction and arrangement of the parts thereof without departing from the spirit and scope of the invention and without sacrificing all of its material advantages, the form hereinbefore described being merely a preferred or emplementary embodiment thereof.

I claim:

1. A control for use with a humidifier, capable of drawing electrical power from an electrical power source, adapted to be coupled to a hot-air furnace controlled by a thermostat so that moisture is added to heated air leaving said furnace at such time as said humidifier is energized, said thermostat controlling energization of said furnace and providing relatively short furnace operation cycles in warm weather and relatively longer furnace operation cycles in colder weather, said control being connected to said humidifier and to said electrical power source for said humidifier to energize said humidifier for a predetermined continuous period of time within said furnace operation cycle.

2. The control of claim 1 wherein the predetermined continuous period of time is longer than the duration of the shortest furnace operation cycle which occurs when the ambient temperature is above 0 degrees C. and shorter than the duration of the furnace operation cycle that occurs when the ambient temperature is the lowest usually encountered in the geographic area.

3. The control of claim 1 including means for manual adjustment of said predetermined continuous period of time.

4. A heating system for an enclosed volume, comprising:

a hot-air furnace having an electrically energized blower capable of drawing power from an electrical power source;

a thermostat for controlling the energization of said furnace and said blower to maintain a setpoint temperature within said enclosed volume, said thermostat being operative to control said furnace and said blower so as to provide relatively short energization cycles when the ambient temperature is relatively high and longer energization cycles when the ambient temperature is relatively low;

an electrically powered humidifier connected to said furnace so that heated air from said furnace passes through said humidifier;

and a control connected to said furnace, said humidifier, and said electrical power source, operative to energize said humidifier for a predetermined continuous period of time starting at the beginning of each furnace energization cycle and to de-energize said humidifier at such time as the predetermined continuous period of time terminates or said furnace is de-energized, whichever occurs first.

5. The system of claim 4 including manually adjustable means for controlling the length of said predetermined time period.

6. A control system for an electrically energized humidifier operative to receive the hot air output of a furnace having a blower, comprising:

a timer circuit adapted to measure a predetermined period of time, means for initiating said timer circuit each time said blower is energized, and means for providing electrical power to said humidifier when said energization of said blower begins and terminating electrical power to said humidifier when said energization of said blower stops or said predetermined period of time ends, whichever occurs first.

7. The control system of claim 6, wherein said timer circuit is manually adjustable to control the length of said predetermined period of time.

8. The method of controlling the operation of an electrically energized humidifier of the type used with a furnace having an electrically energized blower comprising:

energizing said humidifier each time said blower is energized for a period which does not exceed the time of energization of said blower or a predetermined time period, whichever is shorter.

9. The method of claim 8 including the step of adjusting the predetermined time period to prevent condensation of moisture from humidified air during periods of low ambient temperature.

10. A control system for an electrically energized humidifier operative to receive the hot air output of a furnace having a blower, comprising:

a timer circuit adapted to measure a predetermined period of time, means for initiating said timer circuit each time said blower is energized, and means for providing electrical power to said humidifier when said energization of said blower begins and terminating electrical power to said humidifier when said energization of said blower stops or said predetermined period of time ends, whichever occurs first, said timer circuit and said humidifier being electrically in series, said timer circuit being adapted to selectively interrupt electrical power to the humidifier within said predetermined period of time in order to derive its own operating electrical power.

11. A heating system for an enclosed volume, comprising:

a hot-air furnace having an electrically energized blower capable of drawing power from an electrical power source;

a thermostat for controlling the energization of said furnace and said blower to maintain a setpoint temperature within said enclosed volume, said thermostat being operative to control said furnace and said blower so as to provide relatively short energization cycles when the ambient temperature is relatively high and longer energization cycles when the ambient temperature is relatively low;

an electrically powered humidifier connected to said furnace so that heated air from said furnace passes through said humidifier;

and a control connected to said furnace, said humidifier, and said electrical power source, comprising:

a timer circuit adapted to measure a predetermined period of time, means for initiating said timer circuit each time said blower is energized, and means for providing electrical power to said humdifier when said energization of said blower begins and terminating electrical power to said humidifier when said energization of said blower stops or said predetermined period of time ends, whichever occurs first, said timer circuit and said humdifier being electrically in series, said timer circuit being adapted to selectively interrupt electrical power to the humdifier before said predetermined period of time ends in order to derive its own operating electrical power.

* * * * *